US010641167B2

(12) United States Patent
Hedman

(10) Patent No.: US 10,641,167 B2
(45) Date of Patent: May 5, 2020

(54) METHOD FOR PROVIDING VARIABLE COMPRESSION RATIO IN AN INTERNAL COMBUSTION ENGINE AND ACTUATOR FOR SAID METHOD

(71) Applicant: HEDMAN ERICSSON PATENT AB, Flen (SE)

(72) Inventor: Mats Hedman, Sparreholm (SE)

(73) Assignee: HEDMAN ERICSSON PATENT AB, Flen (SE)

( * ) Notice: Subject to any disclaimer, the term of this patent is extended or adjusted under 35 U.S.C. 154(b) by 0 days.

(21) Appl. No.: 16/468,824

(22) PCT Filed: Dec. 14, 2017

(86) PCT No.: PCT/SE2017/000049
§ 371 (c)(1),
(2) Date: Jun. 12, 2019

(87) PCT Pub. No.: WO2018/111167
PCT Pub. Date: Jun. 21, 2018

(65) Prior Publication Data

US 2019/0301362 A1 Oct. 3, 2019

(30) Foreign Application Priority Data

Dec. 14, 2016 (SE) ..... 1600344

(51) Int. Cl.
*F02B 75/04* (2006.01)
*F02D 15/04* (2006.01)

(52) U.S. Cl.
CPC ..... *F02B 75/042* (2013.01); *F02D 15/04* (2013.01)

(58) Field of Classification Search
CPC ..... F02D 15/04; F02D 15/00; F02B 75/041; F02B 75/04; F02B 2019/008
See application file for complete search history.

(56) References Cited

U.S. PATENT DOCUMENTS

2003/0097998 A1* 5/2003 Gray, Jr. ..... F02B 1/12 123/48 AA
2003/0192490 A1* 10/2003 Maloney ..... F02B 75/042 123/48 A
2004/0159292 A1 8/2004 Lawrence et al.
(Continued)

FOREIGN PATENT DOCUMENTS

CA 2429820 A1 * 6/2002 ..... F02B 25/18

OTHER PUBLICATIONS

International Search Report and Written Opinion regarding Int'l. Appl. No. PCT/SE2017/000049, dated Mar. 7, 2018, 11 pages.

*Primary Examiner* — Kevin A Lathers
(74) *Attorney, Agent, or Firm* — Foley & Lardner LLP

(57) ABSTRACT

In a combustion chamber of a piston combustion engine there is a displaceable piston that can be moved progressively up or down between an upper and a lower turning position. The displacement takes place via an electrically controlled step motor which is connected to the piston via a hydraulic link, including a hydraulic lock. The lock is deactivated during the displacement a certain number of steps up or down ordered by a motor control system, and when the displacement is ended, the lock is activated by said engine control system and the moving piston is locked in a certain position ordered by the motor control system.

8 Claims, 10 Drawing Sheets

(56) References Cited

U.S. PATENT DOCUMENTS

| | | | | |
|---|---|---|---|---|
| 2009/0223491 | A1 | 9/2009 | Syed et al. | |
| 2010/0294244 | A1 | 11/2010 | Favennec et al. | |
| 2011/0197859 | A1* | 8/2011 | Wilson ..... | F02B 75/041 123/48 R |

* cited by examiner

METHOD FOR PROVIDING VARIABLE COMPRESSION RATIO IN AN INTERNAL COMBUSTION ENGINE AND ACTUATOR FOR SAID METHOD

BACKGROUND

The present invention relates to an increase of the efficiency coefficient in all types of piston combustion engines and further making it possible to minimize the creating of NOX (NitrogenOxides) in diesel engines.

One problem to solve in today's diesel engines is to reduce emissions of nitrogen oxides, so-called NOx. A proposed solution is described, and referred to, in Swedish patent application no. 1500404-7 where the possibility of a variable compression ratio is a prerequisite. It can be seen from the proposal that the size of the combustion chamber needs to be controlled with great accuracy and then adapted to the volume of air supplied, in a preferred embodiment, via a freely controllable inlet valve during the intake stroke.

There are several proposed solutions for variable compression ratios, but only a few of them include that the combustion chamber, at least a substantial part of it, is present above the piston in the cylinder head. By placing the variable combustion chamber, from a size perspective view, in the cylinder head, simultaneously provides an efficiency enhancing solution for all types of piston combustion engines. The diesel engine which usually has a substantial part of the combustion chamber performed as a bowl in the piston can be said to cause the bowl to be moved from the piston to the cylinder head, which means that the combustion chamber size can be made variable.

SUMMARY

The object of the invention is to provide a solution to a variable compression ratio in a diesel engine which fulfil the severe and big demands which concerns the possibility to be able to vary the size of the combustion chamber with high accuracy and at the same time obtain a solution which can in princip be the same for all types of piston combustion engines. This object is obtained by the invention has been given the characterizing clauses mentioned in the claims mentioned after the description.

A motor control system decides, for example based on the position of a gaspedal, a variety of actions, e.g. the amount of air to be supplied to the compression rate, the amount of fuel to be supplied and exactly when it is to be supplied, the size of the combustion chamber to provide optimum efficiency and the formation of a minimum of NOx, etc.

Herein, the invention is described only by showing how the regulation and control of the size of the combustion chamber is carried out by command and input from the engine control system, not the basis for these.

In the combustion chamber there is a movable piston that can be moved progressively upwards or downwards between an upper and a lower turning
position. The displacement takes place via an electrically controlled step motor which is connected to the piston via a hydraulic link, including a hydraulic lock. During the influence of a motor control system decided movement, a certain number of steps up or down, the lock deactivates and when movement is completed, the lock activates and the movable piston is locked in a certain position by the engine control system. During combustion and expansion stroke, the lock is activated which protects the step motor, its attachment and bearing from mechanical stress.

The lock is activated/deactivated by an electromagnet on input from the engine control system. The lock consists of a so-called pressure-relieved hydraulic lock, which on one hand reduces stress on the lock and also minimizes friction which facilitates activation/deactivation of the lock. The mentioned steps can be very small, millimeters, hundreds of millimeters, or less. At the same time, a step motor allows the movement to take place with high force, which is advantageous if there are combustion residues on the walls of the combustion chamber that must be overcome. Replacement of the piston occurs after the hydraulic lock is deactivated and easiest with the aid of a mechanical spring. Variations of the pressure in the combustion chamber cause the plunger to minimally move and preventing from being stuck.

A further description is made with the aid of figures as shown below.

DETAILED DESCRIPTION

Figure 1:
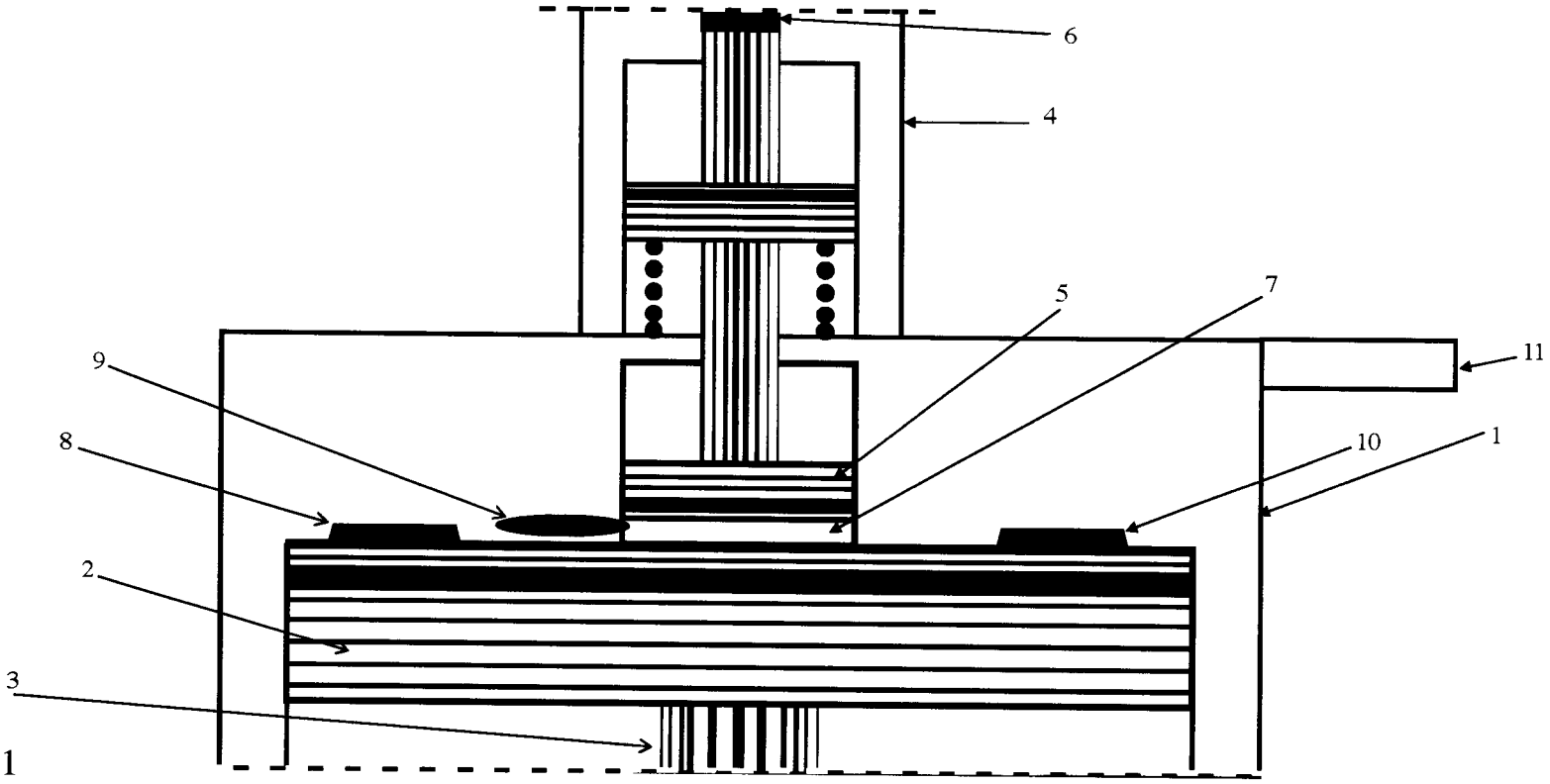
FIG. 1 shows schematically a section through the upper part of a diesel engine cylinder with cylinder head where the combustion chamber volume is adapted to small engine load and with the engine piston in its upper turning position after a compression stroke.

FIG. 1 shows a schematic view of a cylinder of a diesel engine with a cylinder head 1 and with a piston 2 mounted on a crank shaft 3. An actuator 4 with [[a]] a principal function according to the present invention is shown in FIG. 4-10. A piston 5 can by an input from a motor control system, not shown, be controlled to take different positions in the combustion chamber 7 and thereby vary the volume on the portion under the piston, whereby an essential part of the combustion takes place when fuel is sprayed by the injector 9.

Said different positions are locked in a hydraulic circuit 6. An outlet valve 8 controlled by a cam shaft or by an actuator according to ex.g. patent (SE535886 C2, SE1100435A1) are schematically shown as well as an inlet valve 10, which preferably, but not necessary is opened and closed by an actuator on input from the control system of the engine, with a function according ex.g. any of said mentioned patents. An air mass meter 11 to measure the amount of air being introduced during the intake stroke through the inlet valve 10. The piston 2 is shown in upper turning position where it is prohibited to mechanically contact the cylinder head including the poppet valves 8, 10.

Figure 2:
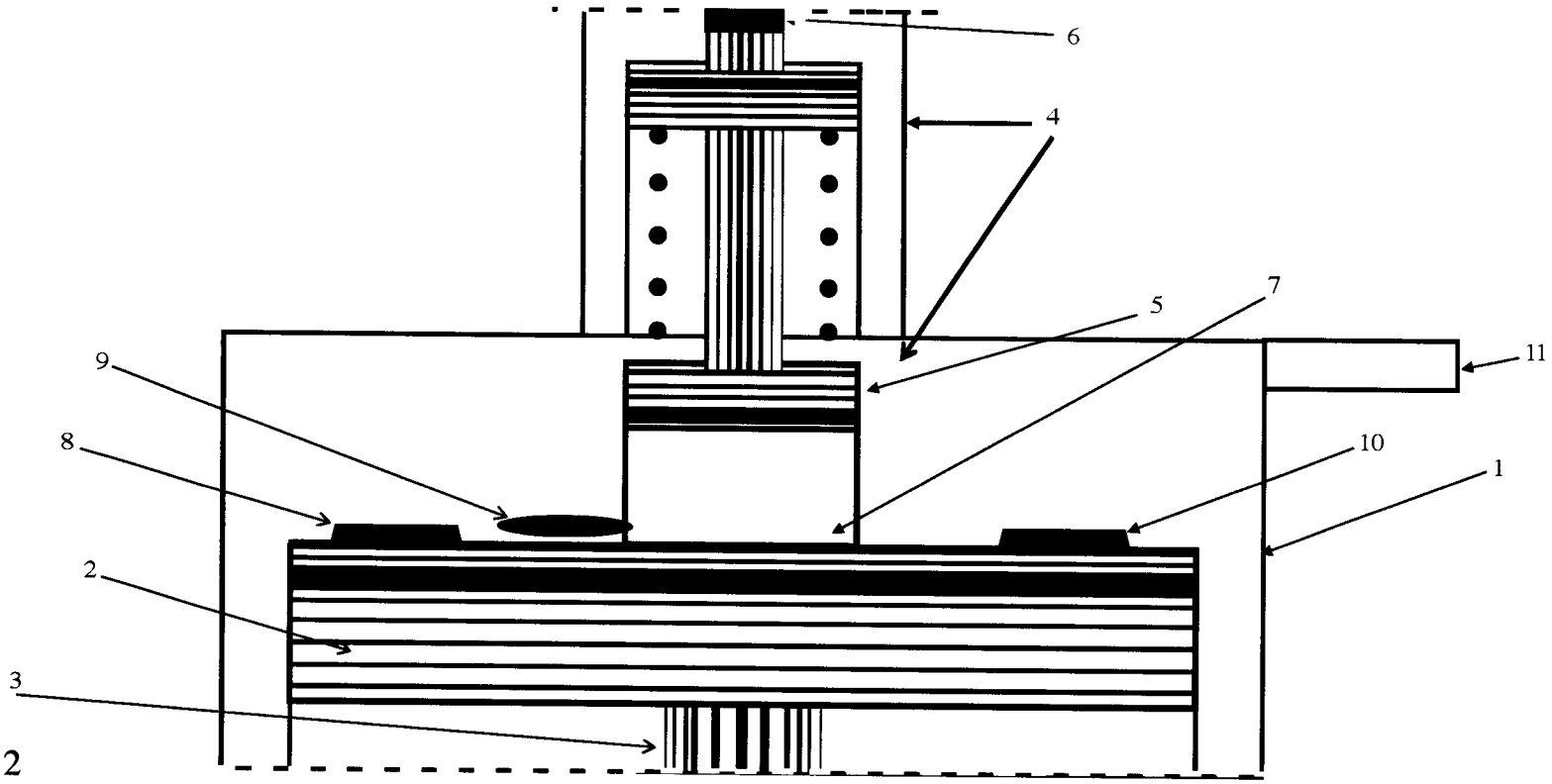
FIG. 2 shows schematically a section through the upper part of a diesel engine cylinder with cylinder head where the combustion chamber volume is adapted for maximum engine load and with the motor piston in its upper turning position after a compression stroke.

FIG. 2 shows the piston 5 in its upper position where the combustion chamber is at its maximum in size, and the engine can, but must not, be maximally loaded. Still can, as today more or less engine load be taken out depending how much fuel being injected, in such a case with the exhaust emission valid today. It may be advantageously having a little bowl in the piston where the bowl of today is situated, that is directely under the combustion chamber.

Figure 3:
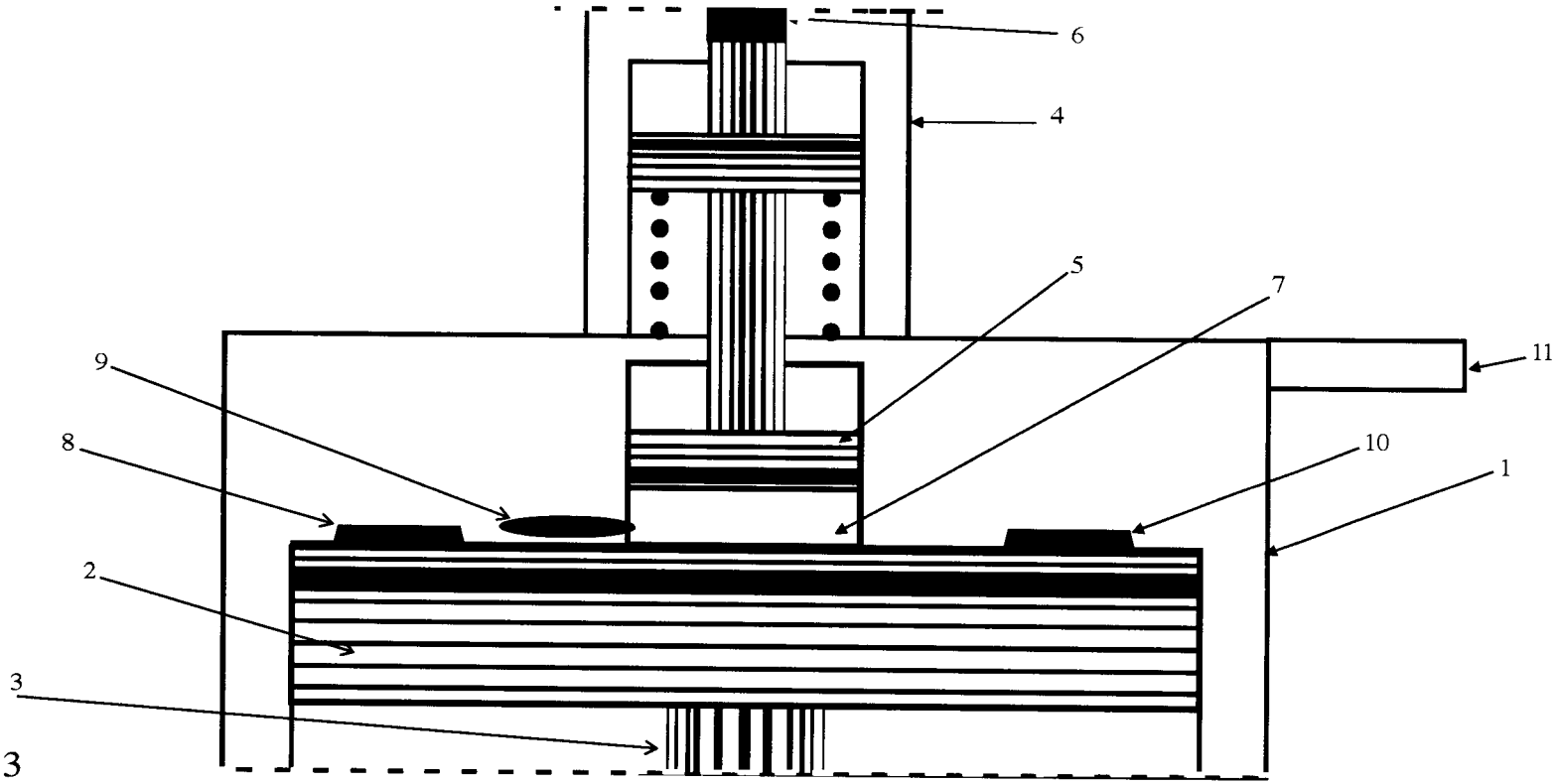
FIG. 3 shows schematically a section through the upper part of a diesel engine cylinder with cylinder head where the combustion chamber volume is adapted to medium-sized engine load and with the engine's piston in its upper turning position after a compression stroke

FIG. 3 shows a schematic view of the upper part of the cylinder of the engine with cylinder head where the volume of the combustion chamber is adapted to a middle big engine load and with the piston of the engine in its upper turning position after a compression stroke. In princip all air from the intake stroke is pressed into said volume. At the end of the compression stroke a suitable amount of fuel is injected to minimize NOx. Said activities are are controllably performed by the control system of the engine.

Figure 4:
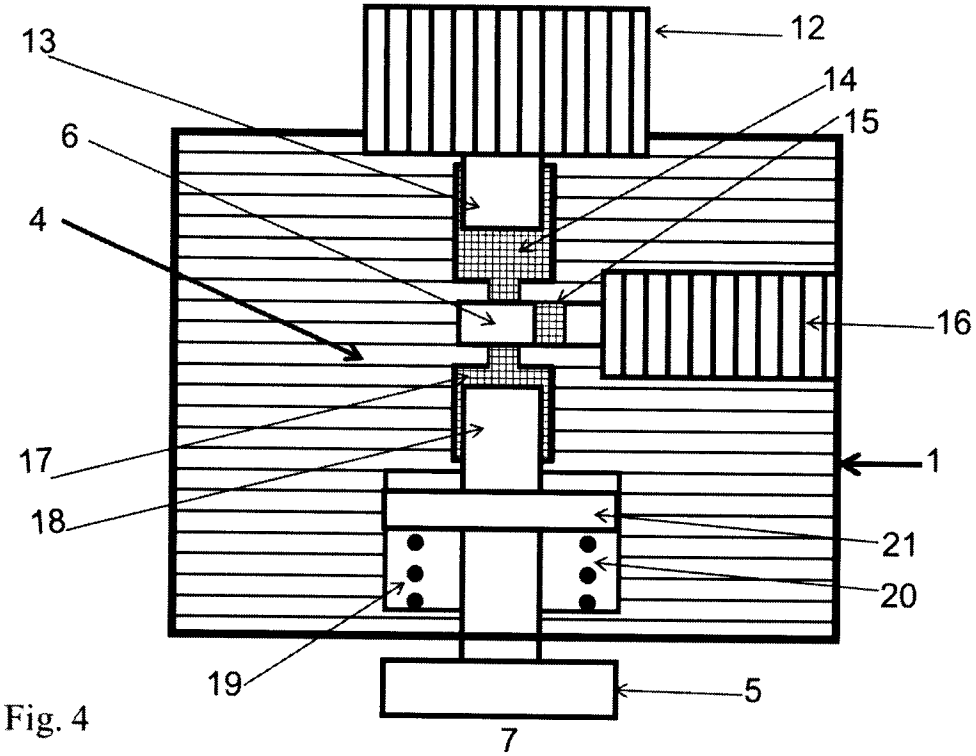
FIGS. 4-10 show schematically how an actuator 4 is deplacing a piston in a combustion chamber, ex.g. in a cylinder head of a diesel engine, shown in FIG. 1-3, and makes the piston to take different positions in dependent of the motor load. It is stressed that the invention can be used with all types of piston combustion engines.

FIG. 4 display part of the cylinder 1 with an actuator 4 according to the invention having a step motor 12 with a vertical, upward or downward displaceable shaft 13 running in a chamber 14 filled with hydraulic fluid. Further, there is shown a hydraulic lock 6 consisting of a valve with an opening where the valve is horizontal, left or right, displaceable in chamber 14 or between chamber 14 and below chamber 17 via an electromagnet 16 or other type of electrical element, for opening and closing flow of hydraulic fluid between chamber 14 and a chamber 17 also filled with hydraulic fluid. Further, the piston 5 running in the combustion chamber 7 is shown, which in itself is shown in more detail in FIGS. 1-3. The piston has a shaft 18 the upper part of which is present in the chamber 17 and displaceable disposed therein. A chamber 20 with a mechanical spring 19 which makes the piston 5 slidable upwardly by acting between the floor of the chamber and a flange 21 existing on the shaft 18. The valve with its aperture 15 can be displaced in both directions by a double acting electromagnet or in a direction via an electromagnet and in the other direction via a mechanical spring, not shown.

Figure 5:
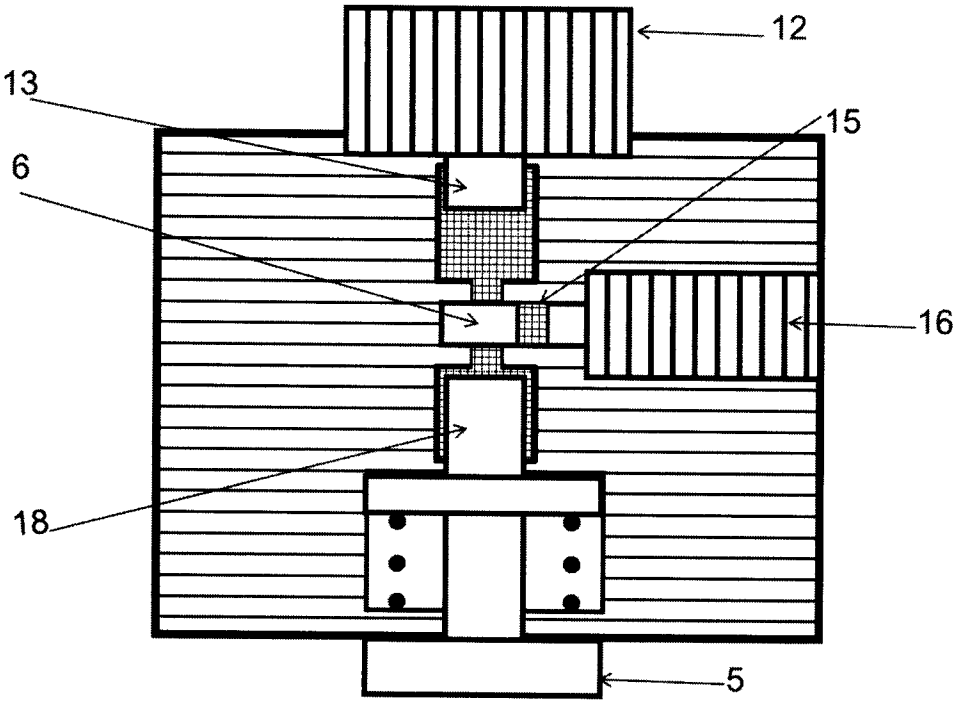

FIG. 5 shows the step motor 12 with the shaft 13 maximally displaced upwards and the piston 5 with the shaft 18 likewise is maximally displaced upwardly. The hydraulic lock with the valve 6 shifted to the right has shut the connection between the chambers 14 and 17. The step motor can not affect the piston 5 in this position.

Figure 6:
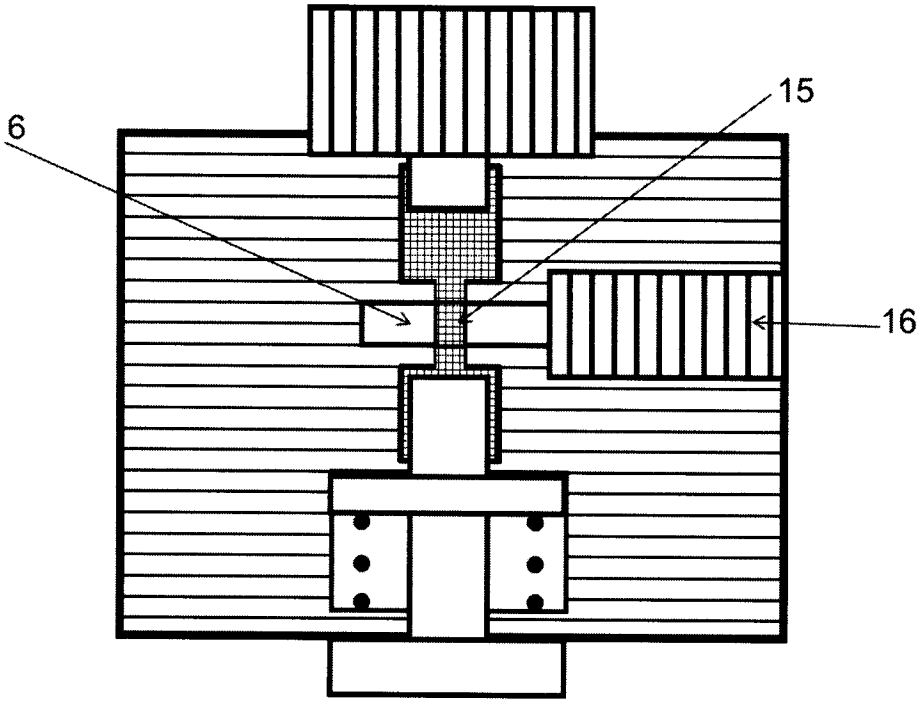

FIG. 6 shows the hydraulic lock deactivated by the electromagnet repositioning the valve 6 to the left so that its opening 15 creates connection between the hydraulic fluid filled chambers 14 and 17.

Figure 7:
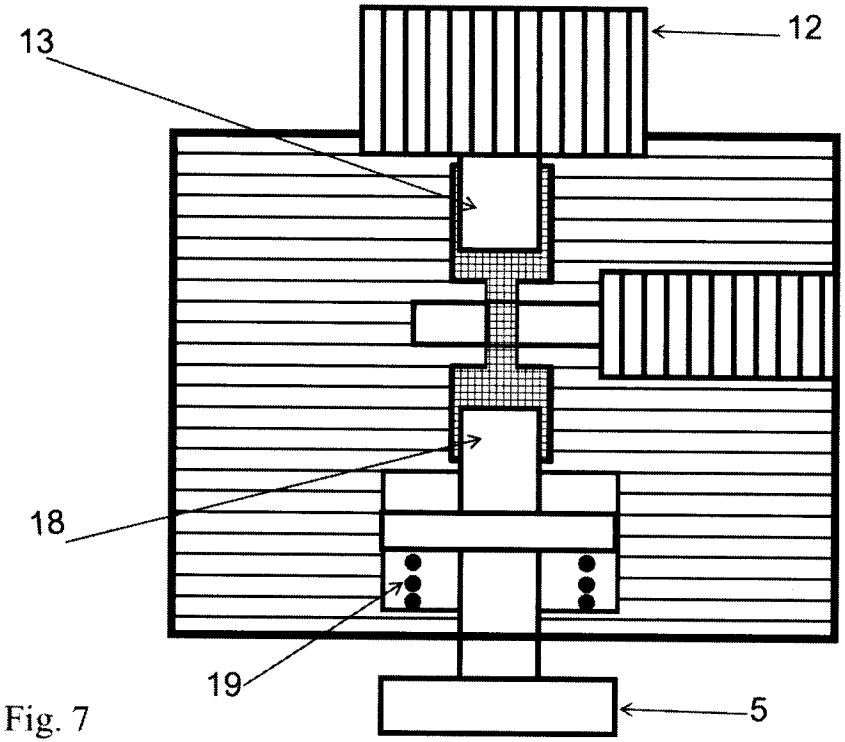

FIG. 7 shows that the step motor 12 repositioned the shaft 13 downwardly, thereby pushing hydraulic fluid from the chamber 14 through the opening 15 in the valve 6 to the chamber 17 and thereby pushing the piston shaft 18 with the piston 5 downwardly under compression of the spring 19. Thus the combustion chamber, not directly illustrated, decreases.

Figure 8:
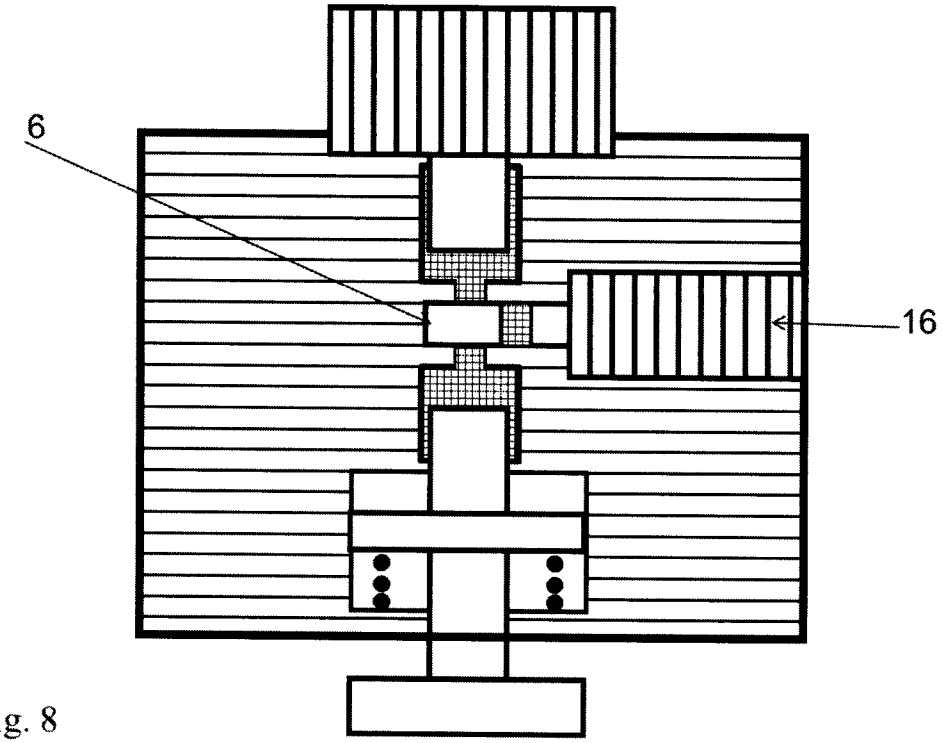

FIG. 8 shows the electromagnet 16 with the valve 6 in a position where the connection between the chambers 14 and 16 is switched of and hence the hydraulic lock is activated. The piston 5 can neither move upwards nor downwards.

Figure 9:
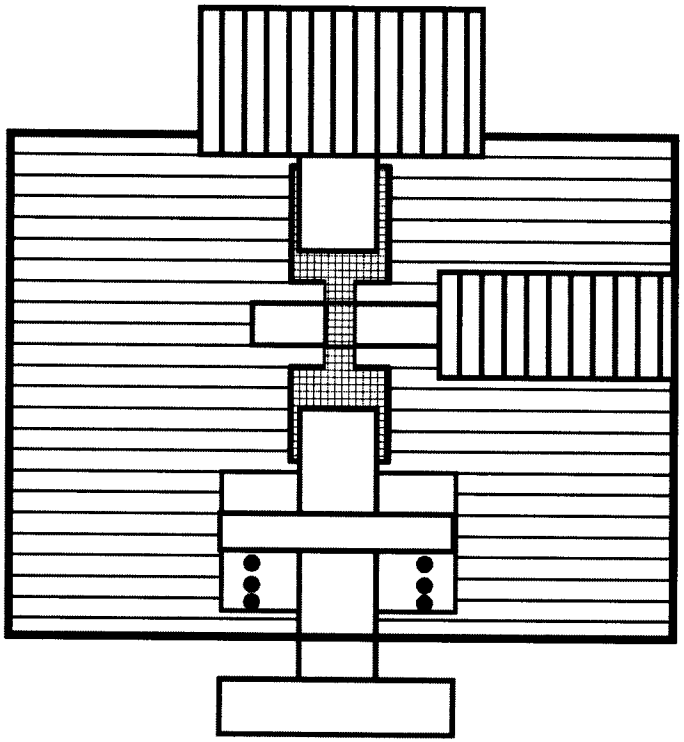

FIG. 9 shows the hydraulic lock deactivated.

Figure 10:
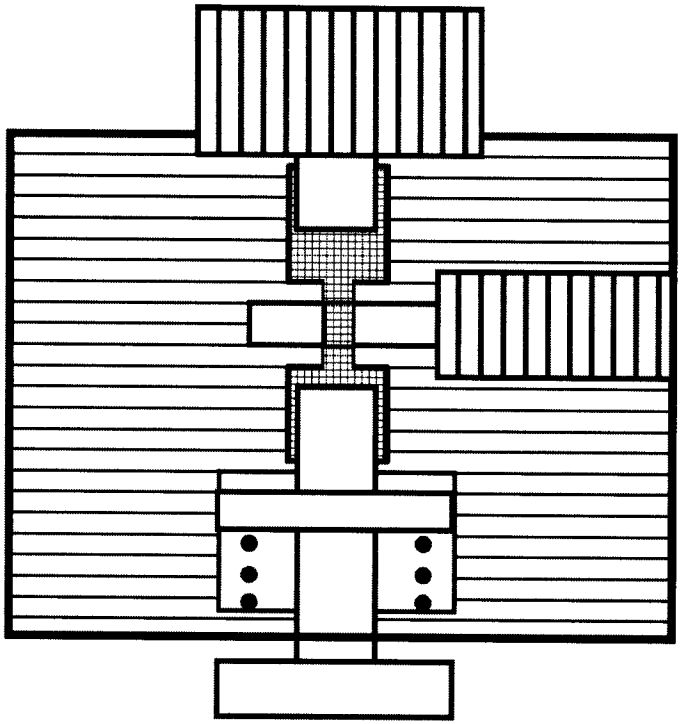

FIG. 10 shows a position where the step motor 12 has moved the shaft 13 upwards, whereby, by action of the spring 19, hydraulic fluid is pressed from the chamber 17 to 14 and the piston shaft 18 with its piston 5 has been moved upwards.

Actions undertaken by a man skilled in the art have not been described, as the hydraulic fluid is suitably engine oil, how the volume of hydraulic fluid is substantially kept constant, selection and placement of the engine control system, deciding the combustion chamber size, etc. An engine control system is obvious today and therefore it is not mentioned in the claims that the action of the electromagnet and step motor is controlled by the engine control system.

The invention claimed is:

1. A method to control the size of a combustion chamber by an actuator in the cylinder head of a piston combustion engine comprising:

A combustion chamber

A vertically displaceable piston arranged in the combustion chamber; and

An actuator comprising:

A first chamber with a first shaft extending through the first chamber and connected to the piston, the first shaft having a flange and a spring disposed in the first chamber, the spring acting between the flange and a chamber floor to force the piston in an upward direction;

A second chamber and a third chamber filled with hydraulic fluid and separated by a valve with an opening, wherein the valve is horizontally repositionable via an electromagnet;

A step motor and a second shaft vertically displaceable by said step motor in the second chamber, Wherein an upper part of the first shaft extends into the third chamber such that the hydraulic fluid may act thereon, the method comprising changing the size of the combustion chamber by;

displacing the valve with the electromagnet so that the opening connects the second and third chambers, and displacing the second shaft using the step motor to cause a flow of hydraulic fluid between the second chamber and the third chamber, thereby repositioning the first shaft and the thereto-connected piston.

2. The method of claim 1, comprising downwardly displacing the second shaft by the step motor, thereby forcing hydraulic fluid from the second chamber to the third chamber and downwardly displacing the first shaft to compress the spring while reducing the size of the combustion chamber until displacement of the second shaft is ended.

3. The method of claim 2, comprising ending a repositioning of the first shaft by displacing the valve so that the opening no longer connects the second chamber and the third chamber, whereby the piston is no longer displaceable.

4. The method of claim 1, comprising ending a repositioning of the first shaft by displacing the valve so that the opening no longer connects the second chamber and the third chamber, whereby the piston is no longer displaceable.

5. The method of claim 1, comprising displacing the second shaft upwards by the step motor, thereby forcing the hydraulic fluid from the third chamber to the second chamber by action of the spring on the flange of the first shaft, wherein the piston is moved upward at a same time as the spring expands such that a size of the combustion chamber increases until displacement of the second shaft has come to an end.

6. The method of claim 5, comprising ending a repositioning of the first shaft by displacing the valve so that the opening no longer connects the second chamber and the third chamber, whereby the piston is no longer displaceable.

7. The method of claim 1, comprising ending a repositioning of the first shaft by displacing the valve so that the opening no longer connects the second chamber and the third chamber, whereby the piston is no longer displaceable.

8. A cylinder head for a diesel engine comprising:

a combustion chamber arranged in the cylinder head;

a vertically displaceable piston arranged in said combustion chamber; and an actuator comprising:

a first chamber;

a first shaft connected to the piston, the first shaft extending through the first chamber and provided with a flange disposed in the chamber;

a spring arranged between the flange and a floor of the first chamber;

a second chamber and a third chamber filled with hydraulic fluid;

a valve provided with an opening between the second and third chambers;

an electromagnet arranged to actuate the valve;

a second shaft displaceably arranged in the second chamber; and a step motor arranged to displace the second shaft, wherein an upper part of the first shaft extends into the third chamber such that the hydraulic fluid may act thereon to allow for changing a size of the combustion chamber by displacing the valve so that the opening connects the two hydraulic fluid chambers and by displacing the second shaft using the step motor to cause a flow of hydraulic fluid between the second chamber and the third chamber, thereby repositioning the first shaft and the thereto connected piston.

* * * * *